US007581569B2

(12) United States Patent
Beck

(10) Patent No.: US 7,581,569 B2
(45) Date of Patent: Sep. 1, 2009

(54) SCREEN FOR A VIBRATORY SEPARATOR HAVING WEAR REDUCTION FEATURE

(75) Inventor: Jeffrey L. Beck, Leola, PA (US)

(73) Assignee: Lumsden Corporation, Lancaster, PA (US)

( * ) Notice: Subject to any disclaimer, the term of this patent is extended or adjusted under 35 U.S.C. 154(b) by 0 days.

(21) Appl. No.: 11/691,522

(22) Filed: Mar. 27, 2007

(65) Prior Publication Data

US 2008/0237405 A1 Oct. 2, 2008

(51) Int. Cl.
*D03D 15/02* (2006.01)
*B21F 27/18* (2006.01)
*D03D 25/00* (2006.01)

(52) U.S. Cl. ..... 139/425 R; 139/425 A; 245/8

(58) Field of Classification Search ..... 139/425 R, 139/425 A; 2/1, 2, 5, 6, 8, 9
See application file for complete search history.

(56) References Cited

U.S. PATENT DOCUMENTS 1,078,380 A * 11/1913 Reynolds ..... 140/7
1,339,541 A * 5/1920 Barnes ..... 245/2
1,378,489 A * 5/1921 Sommer ..... 245/8
1,403,742 A * 1/1922 De Rochefort-Lucay .... 359/443
1,459,845 A * 6/1923 Mitchell ..... 209/403
1,678,941 A * 7/1928 Helman ..... 140/7
1,747,631 A * 2/1930 Helman ..... 245/8
1,767,814 A * 6/1930 Reynolds ..... 209/401
2,003,124 A * 5/1935 Specht ..... 245/8
2,078,940 A * 5/1937 Grebe ..... 245/8
2,088,447 A * 7/1937 Specht ..... 245/8
2,088,448 A * 7/1937 Specht ..... 245/8
2,122,592 A * 7/1938 Specht ..... 139/425 A
2,132,252 A * 10/1938 Weber ..... 139/425 A
2,271,662 A * 2/1942 Rubissow ..... 140/7
2,288,512 A * 6/1942 Buchanan ..... 139/425 A
2,604,989 A * 7/1952 Warhol ..... 209/401
2,874,730 A * 2/1959 Pomeroy ..... 139/425 R
2,926,785 A * 3/1960 Sander ..... 209/401
3,266,130 A * 8/1966 Glaze ..... 228/182

(Continued)

OTHER PUBLICATIONS http://thefreedictionary.com/parallel; "Parallel", The American Heritage dictionary, 2000.*

(Continued)

*Primary Examiner*—Bobby H Muromoto, Jr.
(74) *Attorney, Agent, or Firm*—Barley Snyder LLC

(57) ABSTRACT

A screen for a vibratory separator includes a woven wire cloth extending in a substantially flat plane. The woven wire cloth has a plurality of warp wires and a plurality of weft wires. Each of the warp wires and each of the weft wires have a cross-section with a height extending substantially perpendicular to the plane of the woven wire cloth and a width extending substantially parallel to the plane of the woven wire cloth. The warp wires are arranged substantially parallel to each other and define openings in the woven wire cloth for the passage of material there through. The height of each of the warp wires is larger than the width thereof. The weft wires extend substantially perpendicular to the warp wires and are woven through the warp wires in groups at spaced intervals. The height of each of the weft wires is smaller than the width thereof.

24 Claims, 5 Drawing Sheets

U.S. PATENT DOCUMENTS 3,545,705 A * 12/1970 Hodgson ..... 245/8
3,716,138 A * 2/1973 Lumsden ..... 209/401
3,747,770 A * 7/1973 Zentis ..... 210/402
3,915,202 A * 10/1975 Curtis et al. ..... 139/425 A
4,062,769 A * 12/1977 Simonson ..... 209/399
4,142,557 A * 3/1979 Kositzke ..... 139/425 A
4,239,065 A * 12/1980 Trokhan ..... 139/383 AA
4,290,209 A * 9/1981 Buchanan et al. ..... 34/123
4,481,079 A * 11/1984 Dawes ..... 162/348
4,491,517 A * 1/1985 Janovac ..... 209/401
5,097,872 A * 3/1992 Laine et al. ..... 139/426 R
5,117,865 A * 6/1992 Lee ..... 139/383 A
5,407,737 A * 4/1995 Halterbeck et al. ..... 442/195
5,609,936 A * 3/1997 Kohler et al. ..... 428/107
5,613,527 A * 3/1997 Zimmermann et al. .. 139/383 A
5,944,197 A * 8/1999 Baltzer et al. ..... 209/400
5,988,397 A * 11/1999 Adams et al. ..... 209/401
6,283,302 B1 * 9/2001 Schulte et al. ..... 209/399
6,305,432 B1 * 10/2001 Sacks et al. ..... 139/425 R
6,457,588 B1 * 10/2002 Schulte et al. ..... 210/388
2003/0054192 A1 * 3/2003 Fidi et al. ..... 428/624

OTHER PUBLICATIONS

Hein, Lehmann & Co. Ag; Serpa- and Veno- Screens for difficult screening material; brochure; Fichtenstraβe, Germany.

* cited by examiner

SCREEN FOR A VIBRATORY SEPARATOR HAVING WEAR REDUCTION FEATURE

FIELD OF THE INVENTION

The invention relates to a screen for a vibratory separator comprising a woven wire cloth having a plurality of warp wires arranged substantially parallel to each other that define openings in the woven wire cloth and a plurality of weft wires that extend substantially perpendicular to the warp wires that are woven through the warp wires in groups at spaced intervals.

BACKGROUND

Screens mounted on vibratory separators are typically used by quarries to separate loose or suspended materials by grade and/or size. The screen typically consists of a woven wire cloth having a plurality of warp wires arranged and configured to form a plurality of openings therein. A plurality of fill or weft wires are woven through the warp wires to maintain the warp wires in spaced relation to each other. Each of the warp and weft wires has a substantially round cross-section. As the screen is vibrated, the material having a smaller size than the openings in the woven wire cloth is passed through the openings in the woven wire cloth, and the material having a larger size than the openings in the woven wire cloth are guided over and off of a top surface of the woven wire cloth onto a pile by the weft wires.

In the above described screen, problems occur in that the material that is to be separated gradually wears down the material of the warp and weft wires thereby altering the dimensions of the warp and weft wires. For example, when the dimensions of the warp wires are altered, the dimensions of the openings in the woven wire cloth are also altered causing the woven wire cloth to improperly separate the material passing through the openings. Additionally, when the dimensions of the weft wires are altered, the weft wires are unable to properly secure the warp wires in spaced relation to each other.

It is therefore desirable to provide a screen for a vibratory separator wherein wear of the warp and/or weft wires of the woven wire cloth is prevented so that the weft wires are able to properly secure the warp wires in spaced relation to each other and the volume of flow of the material through the openings in the woven wire cloth is not impeded.

BRIEF SUMMARY

A screen for a vibratory separator comprises a woven wire cloth extending in a substantially flat plane. The woven wire cloth has a plurality of warp wires and a plurality of weft wires. Each of the warp wires and each of the weft wires have a cross-section with a height extending substantially perpendicular to the plane of the woven wire cloth and a width extending substantially parallel to the plane of the woven wire cloth. The warp wires are arranged substantially parallel to each other and define openings in the woven wire cloth for the passage of material there through. The height of each of the warp wires is larger than the width of each of the warp wires. The weft wires extend substantially perpendicular to the warp wires. The weft wires are woven through the warp wires in groups at spaced intervals. The height of each of the weft wires is smaller than the width of each of the weft wires.

A screen for a vibratory separator further comprises a woven wire cloth extending in a substantially flat plane. The woven wire cloth has a plurality of warp wires and a plurality of weft wires. The warp wires are arranged substantially parallel to each other and define openings in the woven wire cloth for the passage of material there through. The warp wires are flattened substantially perpendicular to the plane of the woven wire cloth. The weft wires extend substantially perpendicular to the warp wires. The weft wires are woven through the warp wires in groups at spaced intervals. The weft wires being flattened substantially parallel to the plane of the woven wire cloth.

DETAILED DESCRIPTION OF THE EMBODIMENT(S)

Figure 1:
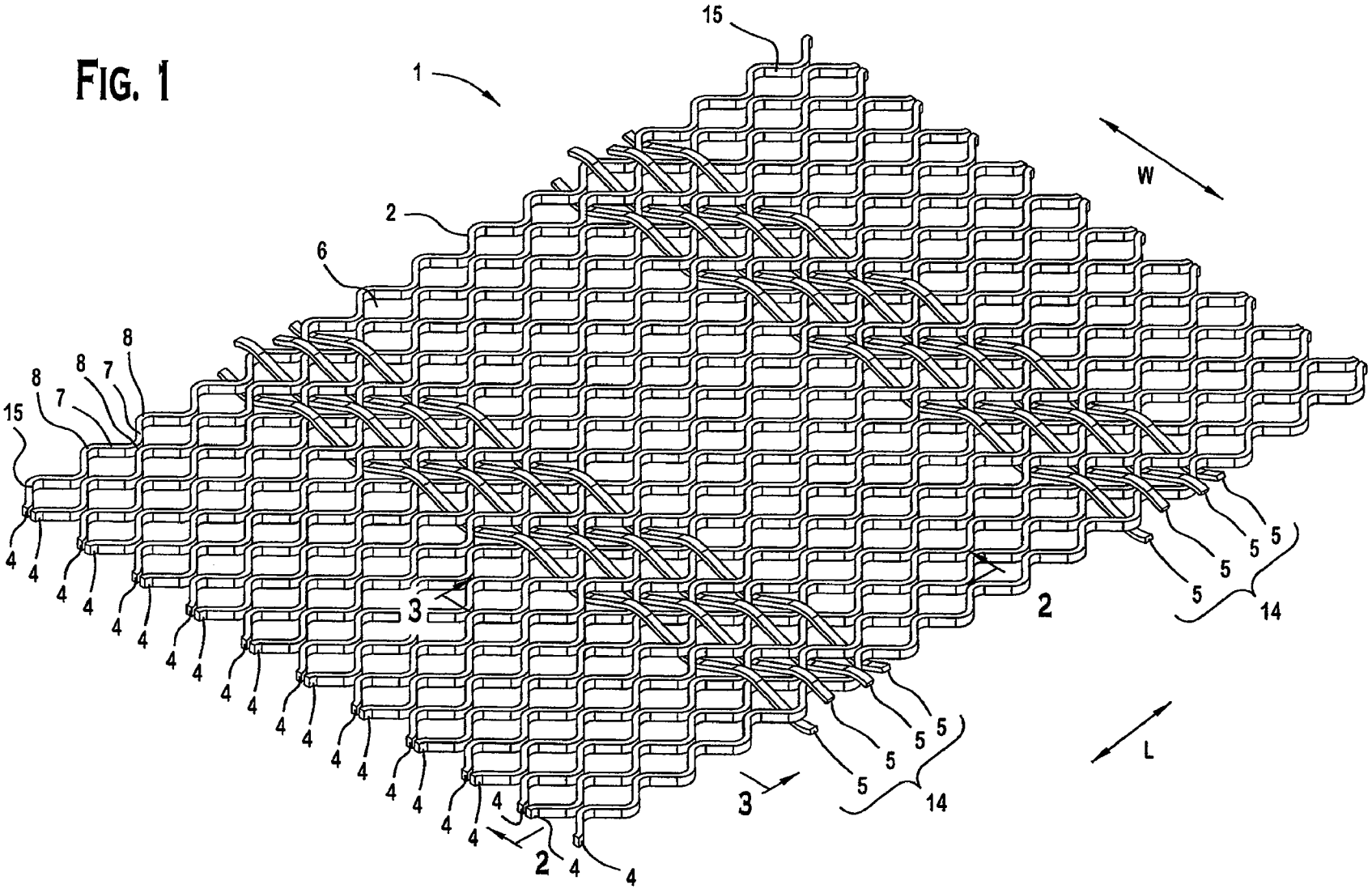
FIG. 1 is a perspective view of a screen for a vibratory separator according to a first embodiment of the invention.
Figure 2:
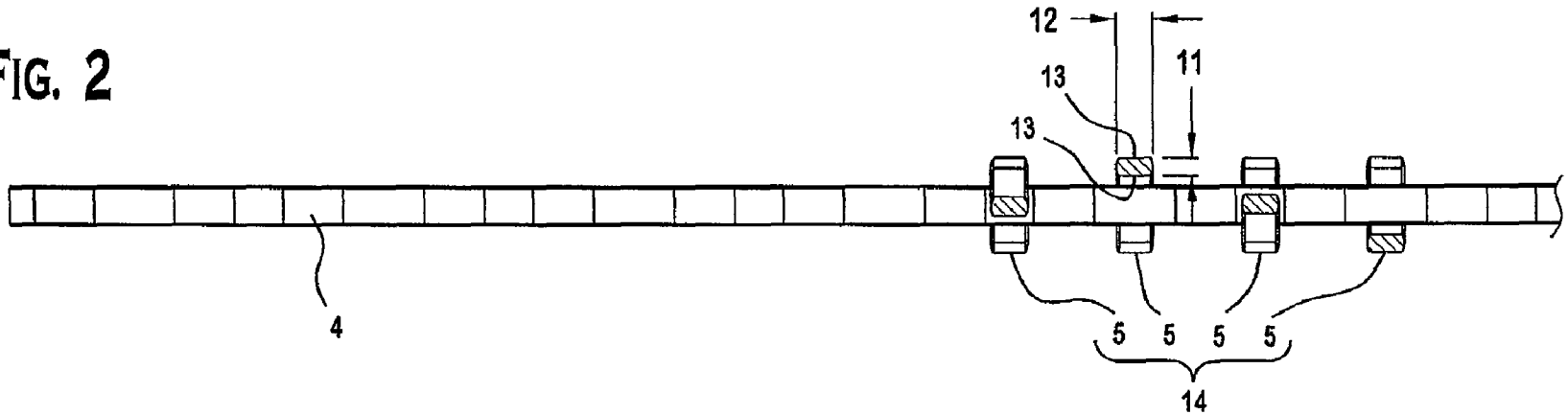
FIG. 2 is a section view taken along line 2-2 of the screen of FIG. 1.
Figure 3:
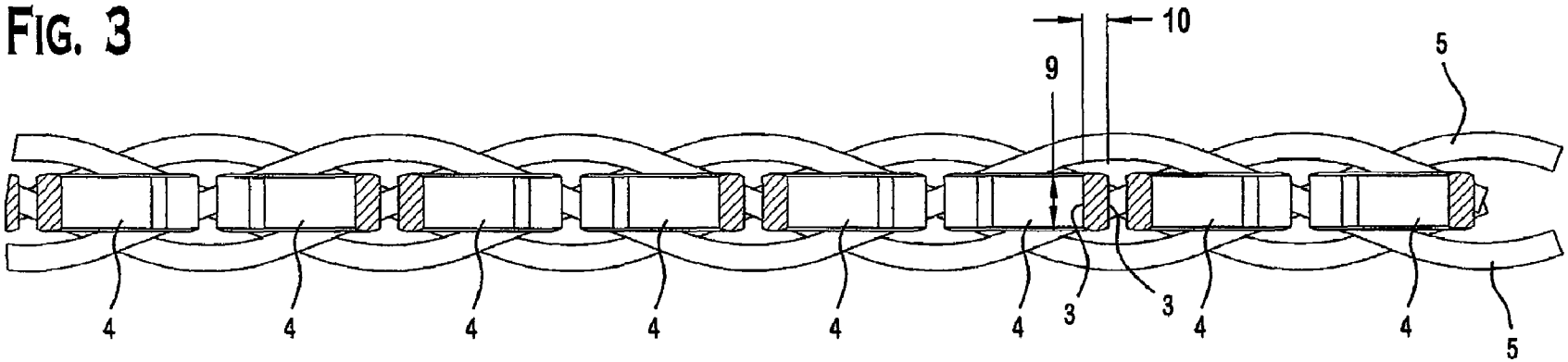
FIG. 3 is a section view taken along line 3-3 of the screen of FIG. 1.

FIGS. 1-3 show a screen 1 for a vibratory separator according to a first embodiment of the invention. As shown in FIG. 1, the screen 1 comprises a woven wire cloth 2. The woven wire cloth 2 extends in a substantially flat plane and includes a plurality of warp wires 4 and a plurality of fill or weft wires 5. The warp wires 4 are disposed substantially in a common plane and are arranged substantially parallel to each other. Each of the warp wires 4 has a substantially wave shape formed by a succession of substantially straight portions 7 connected together by oppositely bent portions 8. The warp wires 4 are arranged such that the bent portions 8 of the warp wires 4 substantially oppose each other and every other one of the warp wires 4 is inverted by about 180 degree with respect to an adjacent one of the warp wires 4 in a direction of width W of the woven wire cloth 2. The warp wires 4 thereby form openings 6 having a substantially diamond shaped configuration.

As shown in FIG. 3, each of the warp wires 4 has a substantially elliptical or oval cross-section. Each of the warp wires 4 has a height 9 extending substantially perpendicular to the substantially flat plane of the woven wire cloth 2 and a width 10 extending substantially parallel to the substantially flat plane of the woven wire cloth 2. The height 9 of each of the warp wires 4 is greater than the width 10 of each of the warp wires 4. The height 9 of the warp wires 4 is about 30-40% greater than the width 10 of the warp wires 4. The height 9 of the warp wires 4 may be about 0.072-0.312 inches, and the width 10 of the warp wires 4 may be about 0.054-0.225 inches. The warp wires 4 may be, for example, shaped wires that have been flattened by rolling or by being drawn through a flattening die. For example, with regard to the warp wires 4, sides 3 of the warp wires 4, which extend substantially perpendicular to the plane of the woven wire cloth 2, would be substantially flattened so that the height 9 of each of the warp wires 4 is greater than the width 10 of each of the warp wires 4. Thus, a substantially round wire having a diameter of 0.105 inches could be flattened to have the height 9 of 0.125 inches and the width 10 of 0.092 inches. The warp wires may be made, for example, from ferrous or non-ferrous steel.

As shown in FIG. 1, the weft wires 5 are disposed substantially in a common plane and are arranged substantially parallel to each other. The weft wires 5 extend substantially perpendicular to the warp wires 4. The weft wires 5 are woven through the warp wires 4 in groups 14 that are arranged at spaced intervals. The number of the groups 14 of the wefts wires 5 and the number of weft wires 5 in each of the groups 14 may vary depending on dimensions and desired configuration of the woven wire cloth 2. The weft wires 5 may be woven through the warp wires 4, for example, by a double or triple heddle loom. The weft wires 5 maintain the warp wires 4 in spaced relation to each other. Alternatively or in addition to the weft wires 5, the warp wires 4 may be maintained in spaced relation to each other by molding the warp wires 4 together at spaced intervals. The warp wires 4 may be molded together, for example, with a polyurethane or rubber material.

As shown in FIG. 2, each of the weft wires 5 has a substantially elliptical or oval cross-section. Each of the weft wires 5 has a height 11 extending substantially perpendicular to the substantially flat plane of the woven wire cloth 2 and a width 12 extending substantially parallel to the substantially flat plane of the woven wire cloth 2. The height 11 of each of the weft wires 5 is smaller than the width 12 of each of the weft wires 5. The width 12 of the weft wires 5 is about 30-40% greater than the height 11 of the weft wires 5. The width 12 of the weft wires 5 may be about 0.072-0.312 inches, and the height 11 of the weft wires 5 may be about 0.054-0.225 inches. The weft wires 5 may be, for example, shaped wires that have been flattened by rolling or by being drawn through a flattening die. For example, with regard to the weft wires 5, sides 13 of the weft wires 5, which extend substantially parallel to the plane of the woven wire cloth 2, would be substantially flattened so that the height 10 of each of the weft wires 5 is smaller than the width 12 of each of the weft wires 5. Thus, a substantially round wire having a diameter of 0.105 inches could be flattened to have the width 12 of 0.125 inches and the height 11 of 0.092 inches. The weft wires 5 may be, for example, made from ferrous or non-ferrous steel.

Holding members (not shown) are arranged on ends 15 of the warp wires 4. The holding members (not shown) extend along the direction of width W of the woven wire cloth 2 and maintain the warp wires 4 under tension along a direction of length L of the woven wire cloth 2. It will be appreciated by those skilled in the art that any holding member that is well known in the art that is configured to maintain the warp wires 4 under tension along the direction of length L of the woven wire cloth 2 may be used.

When the screen 1 is mounted on a vibratory separator (not shown), the vibratory separator (not shown) imparts vibrations on the screen 1 so that a material (not shown) that is to be separated either flows through the openings 6 in the woven wire cloth 2 or is guided over and off of a top surface of the woven wire cloth 2 onto a pile by the weft wires 5. Because the surface of the warp wires 4 that is exposed to the most wear is the width 10 of the warp wires 4 and the width 10 of the warp wires 4 is reduced, the warp wires 4 are more resistant to wear. Thus, the separation of the material (not shown) passing through the openings 9 is less likely to be altered over the life of the screen 1. Further, because the surface of the weft wires 5 that is exposed to the most wear is the height 11 of the weft wires 5 and the height 11 of the weft wires 5 is reduced, the weft wires 5 are more resistant to wear. Thus, the weft wires 5 are able to properly secure the warp wires 4 in spaced relation to each other.

Figure 4:
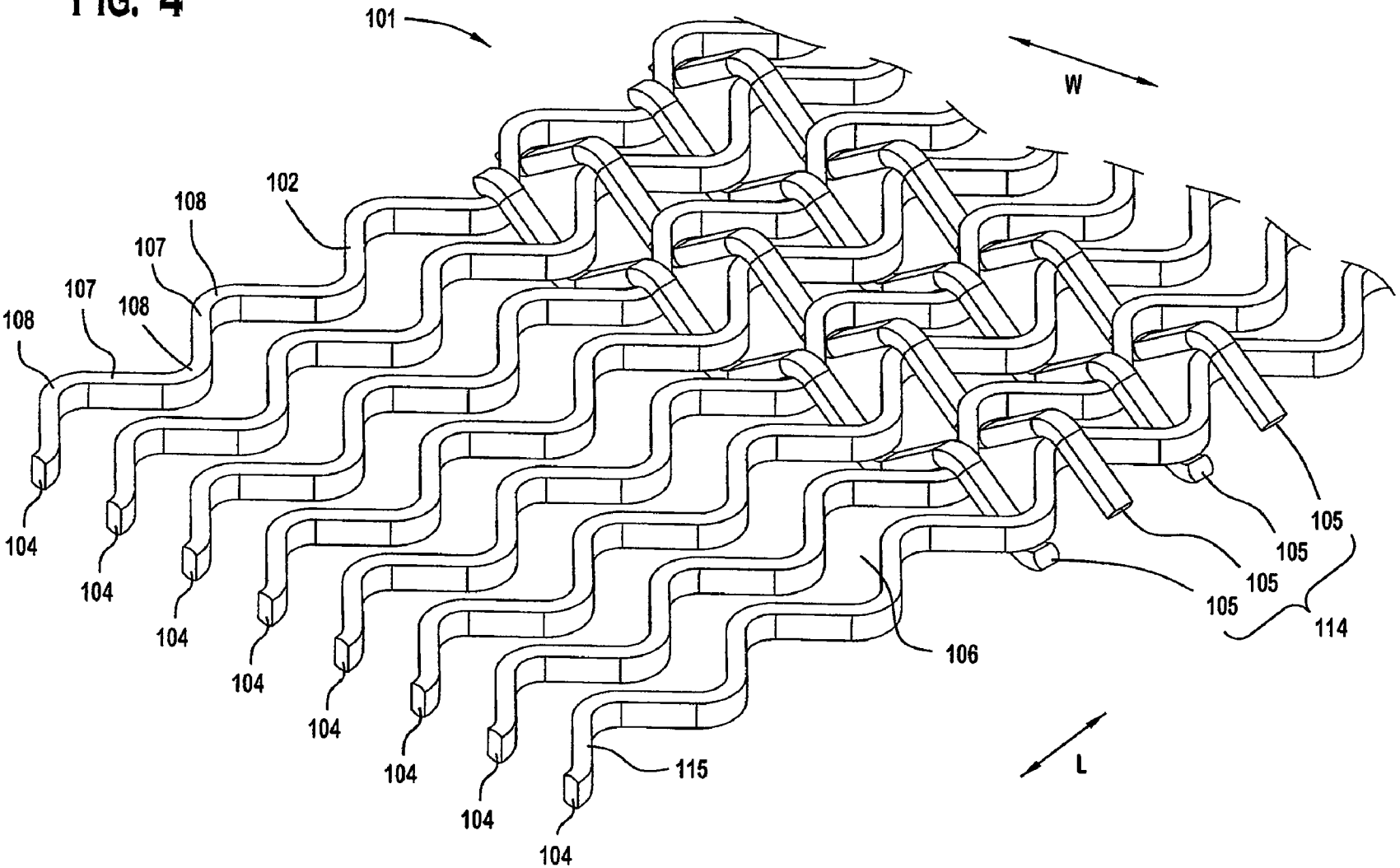
FIG. 4 is a perspective view of a screen for a vibratory separator according to a second embodiment of the invention.

FIG. 4 shows a screen 101 for a vibratory separator according to a second embodiment of the invention. As shown in FIG. 4, the screen 101 comprises a woven wire cloth 102. The woven wire cloth 102 is identical to the woven wire cloth 2 of the first embodiment, except the warp wires 104 are arranged with respect to each other such that the bent portions 108 of the warp wires 104 substantially oppose each other to form openings 106 having a substantially wave shaped configuration. Because the assembly and method of use of the woven wire cloth 102 is the same as the assembly and method of use of the woven wire cloth 2 of the first embodiment, further description thereof will not be provided herein.

Figure 5:
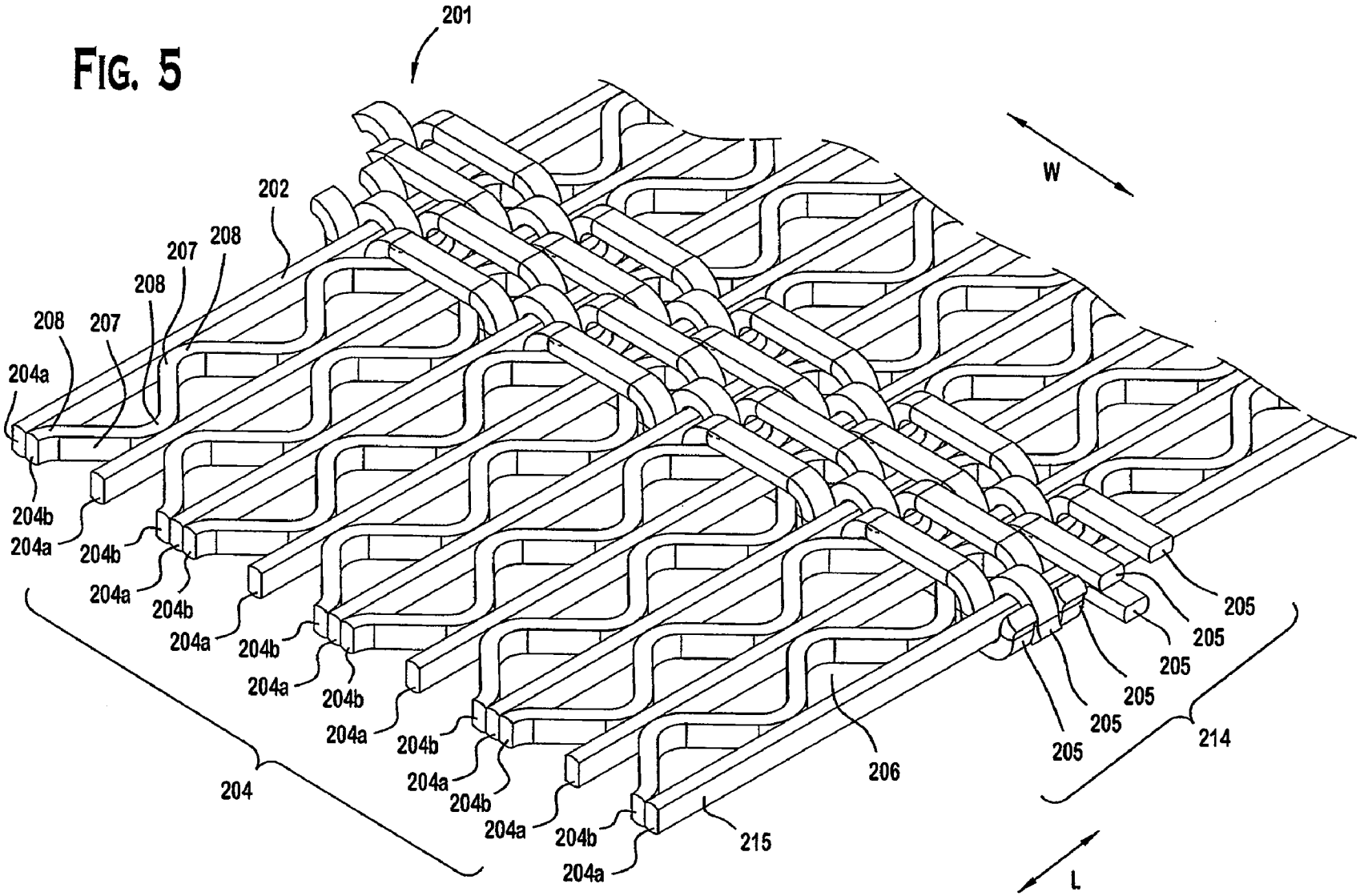
FIG. 5 is a perspective view of a screen for a vibratory separator according to a third embodiment of the invention.

FIG. 5 shows a screen 201 for a vibratory separator according to a third embodiment of the invention. As shown in FIG. 5, the screen 201 comprises a woven wire cloth 202. The woven wire cloth 202 is identical to the woven wire cloth 2 of the first embodiment, except that the warp wires 4 consist of a plurality of substantially straight warp wires 204*a* and a plurality of substantially wave shaped warp wires 204*b*. The substantially wave shaped warp wires 204*b* are formed by a succession of substantially straight portions 207 connected together by oppositely bent portions 208. The warp wires 204 are arranged such that the substantially straight warp wires 204*a* alternate with the substantially wave shaped warp wires 204*b* in a direction of width W of the woven wire cloth 204. Every other one of the substantially wave shaped warp wires 204*b* is inverted by about 180 degrees with respect to an adjacent one of the substantially wave shaped warp wires 204*b*. The warp wires 204 thereby form openings 206 having a substantially triangular shaped configuration. Because the assembly and method of use of the woven wire cloth 202 is the same as the assembly and method of use of the woven wire cloth 2 of the first embodiment, further description thereof will not be provided herein.

Figure 6:
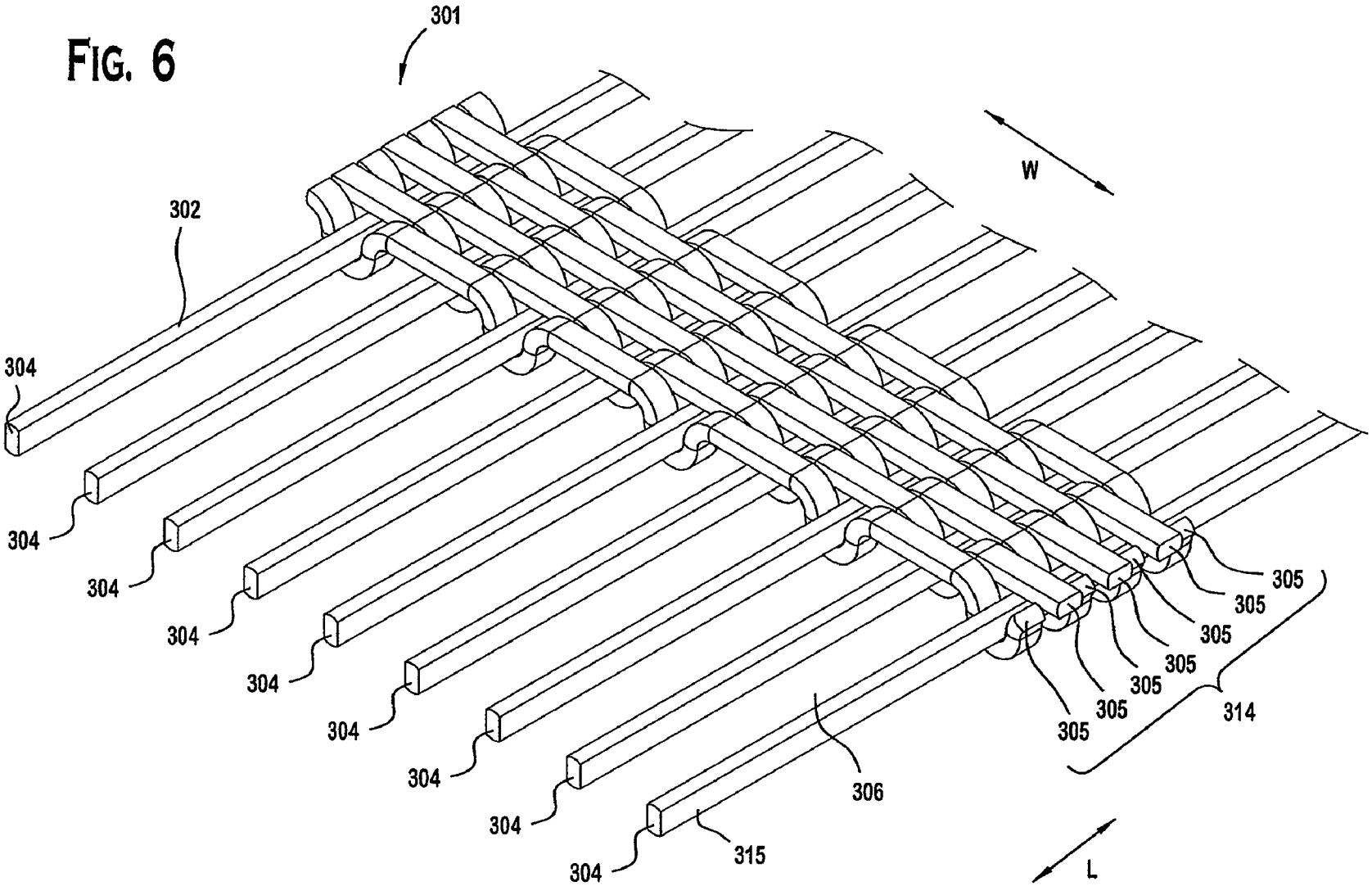
FIG. 6 is a perspective view of a screen for a vibratory separator according to a fourth embodiment of the invention.

FIG. 6 shows a screen 301 for a vibratory separator according to a fourth embodiment of the invention. As shown in FIG. 6, the screen 301 comprises a woven wire cloth 302. The woven wire cloth 302 is identical to the woven wire cloth 2 of the first embodiment, except the warp wires 304 are substantially straight with respect to a direction of length L of the woven wire cloth 302. The warp wires 304 thereby form openings 306 having a substantially rectangular shaped configuration. Because the assembly and method of use of the woven wire cloth 302 is the same as the assembly and method of use of the woven wire cloth 2 of the first embodiment, further description thereof will not be provided herein.

The foregoing illustrates some of the possibilities for practicing the invention. Many other embodiments are possible within the scope and spirit of the invention. For example, although the woven wire cloth 2, 102, 202, 302 is shown and described herein as having openings 6, 106, 206, 306 with certain configurations, it will be appreciated by those skilled in the art that the concepts shown and described herein may be applied to woven wire cloths having other configurations. Additionally, the woven wire cloth 2, 102, 202, 302 may be formed such that just the weft wires 5, 105, 205, 305 or just the warp wires 4, 104, 204, 304 are configured to have the height 9, 11 and the width 10, 12 dimensions shown and described herein. It is, therefore, intended that the foregoing description be regarded as illustrative rather than limiting, and that the scope of the invention is given by the appended claims together with their full range of equivalents.

What is claimed is:

1. A screen for a vibratory separator, comprising:

a woven wire cloth extending in a substantially flat plane, the woven wire cloth having a plurality of warp wires and a plurality of weft wires, each of the warp wires and each of the weft wires having a cross-sectional height extending substantially perpendicular to the plane of the woven wire cloth and a cross-sectional width extending substantially parallel to the plane of the woven wire cloth;

the warp wires being arranged substantially parallel to each other, disposed completely in a common horizontal plane limited by a dimension of the cross-sectional height of the warp wire, and defining openings in the woven wire cloth for the passage of material there through, the height of each of the warp wires being larger than the width of each of the warp wires; and the weft wires extending substantially perpendicular to the warp wires, the weft wires being woven through the warp wires in groups at spaced intervals, the height of each of the weft wires being smaller than the width of each of the weft wires.

2. The screen of claim 1, wherein each of the warp wires and each of the weft wires have a substantially elliptical or oval cross-section.

3. The screen of claim 1, wherein the openings have a substantially diamond shaped configuration.

4. The screen of claim 1, wherein the openings have a substantially wave shaped configuration.

5. The screen of claim 1, wherein the openings have a substantially triangular shaped configuration.

6. The screen of claim 1, wherein the openings have a substantially rectangular shaped configuration.

7. The screen of claim 1, wherein the warp wires and the weft wires are shaped wires.

8. The screen of claim 1, wherein the height of the warp wires is about 30-40% greater than the width of the warp wires.

9. The screen of claim 1, wherein the width of the weft wires is about 30-40% greater than the height of the weft wires.

10. The screen of claim 1, wherein the height of the warp wires is about 0.072-0.312 inches and the width of the warp wires is about 0.054-0.225 inches.

11. The screen of claim 1, wherein the width of the weft wires is about 0.072-0.312 inches and the height of the weft wires is about 0.054-0.225 inches.

12. A screen for a vibratory separator, comprising:

a woven wire cloth extending in a substantially flat plane, the woven wire cloth having a plurality of warp wires and a plurality of weft wires;

the warp wires being arranged substantially parallel to each other, disposed completely in a common horizontal plane limited by a dimension of the cross-sectional height of the warp wire, and defining openings in the woven wire cloth for the passage of material there through, the warp wires being flattened substantially perpendicular to the plane of the woven wire cloth; and the weft wires extending substantially perpendicular to the warp wires, the weft wires being woven through the warp wires in groups at spaced intervals, the weft wires being flattened substantially parallel to the plane of the woven wire cloth.

13. The screen of claim 12, wherein each of the warp wires and each of the weft wires have a substantially elliptical or oval cross-section.

14. The screen of claim 12, wherein the openings have a substantially diamond shaped configuration.

15. The screen of claim 12, wherein the openings have a substantially wave shaped configuration.

16. The screen of claim 12, wherein the openings have a substantially triangular shaped configuration.

17. The screen of claim 12, wherein the openings have a substantially rectangular shaped configuration.

18. The screen of claim 12, wherein the warp wires and the weft wires are shaped wires.

19. The screen of claim 1, wherein at least one warp wire has bent portions, the bent portions only lying within the common horizontal plane.

20. The screen of claim 12, wherein at least one warp wire has bent portions, the bent portions only lying within the common horizontal plane.

21. The screen of claim 1, wherein the cross-sectional height is uniform.

22. The screen of claim 1, wherein the cross-sectional width is uniform.

23. The screen of claim 12, wherein the cross-sectional height is uniform.

24. The screen of claim 12, wherein the cross-sectional width is uniform.

* * * * *